US011207702B2

(12) United States Patent
Zhu

(10) Patent No.: US 11,207,702 B2
(45) Date of Patent: Dec. 28, 2021

(54) HAND-HELD INTEGRAL AIRBRUSH

(71) Applicant: NINGBO BOLT MACHINERY ELECTRONICS & TECHNOLOGY CO., LTD, Ningbo (CN)

(72) Inventor: Kaijun Zhu, Ningbo (CN)

(73) Assignee: Ningbo Bolt Machinery Electronics & Technology Co., Ltd.

( * ) Notice: Subject to any disclaimer, the term of this patent is extended or adjusted under 35 U.S.C. 154(b) by 110 days.

(21) Appl. No.: 16/703,374

(22) Filed: Dec. 4, 2019

(65) Prior Publication Data

US 2020/0376511 A1 Dec. 3, 2020

(30) Foreign Application Priority Data

May 29, 2019 (CN) ..... 201910455559.6

(51) Int. Cl.
*B05B 11/06* (2006.01)
*B05B 11/00* (2006.01)

(52) U.S. Cl.
CPC ..... *B05B 11/062* (2013.01); *B05B 11/061* (2013.01); *B05B 11/3043* (2013.01); *B05B 11/3073* (2013.01)

(58) Field of Classification Search
CPC . B05B 11/062; B05B 11/061; B05B 11/3043; B05B 11/3073; B05B 7/1209; B05B 7/2418; B05B 12/0024; B05B 7/2416; B44D 3/22; A45D 34/00
See application file for complete search history.

(56) References Cited

U.S. PATENT DOCUMENTS

2004/0069869 A1* 4/2004 Ptak ..... B05B 7/2416 239/398
2009/0266916 A1* 10/2009 Fedorov ..... B05B 7/064 239/308
2011/0259978 A1* 10/2011 Ptak ..... B05B 7/2424 239/398
2012/0217318 A1* 8/2012 Mehta ..... B05B 7/0441 239/8
2016/0059251 A1* 3/2016 Ogunyomi ..... B05B 7/2416 239/346
2017/0320078 A1* 11/2017 Jordan ..... B05B 7/0425
2019/0015857 A1* 1/2019 Gouchtchina ..... B05B 7/2408
2019/0076860 A1* 3/2019 Seeberger ..... B05B 7/241

FOREIGN PATENT DOCUMENTS

CN 203389788 U 1/2014
CN 208411279 U 1/2019

* cited by examiner

*Primary Examiner* — Donnell A Long

(57) ABSTRACT

A hand-held integral airbrush comprising a shell provided with a grab handle, wherein an upper accommodating cavity and a lower accommodating cavity are formed in the shell, wherein an airbrush assembly is arranged in the upper accommodating cavity of the shell, and wherein an air pump assembly is arranged in the lower accommodating cavity of the shell and is used for pumping compressed air into the airbrush assembly, wherein the hand-held integral airbrush further comprising a switch part, an operating button which comprises a first control part and a second control part, wherein an air pump and an airbrush are integrated in a the ergonomically designed grab handle, and wherein the air pump and the airbrush are controlled by the trigger-type operating button.

15 Claims, 6 Drawing Sheets

HAND-HELD INTEGRAL AIRBRUSH

BACKGROUND OF THE INVENTION

1. Technical Field

The invention belongs to the technical field of air pump airbrushes, and particularly relates to a hand-held airbrush provided with an air pump and an airbrush.

2. Description of Related Art

Airbrushes are similar to extra-large fountain pens in appearance and are provided with containers used for accommodating liquid pigments and a slim pipe connected with compressed air, and the airbrushes can fulfill uniform hue and color gradation effects, thereby being widely applied to the fields of painting, beauty makeup, and so on.

As a reference of the structure of existing airbrushes, Chinese Utility Model Patent Publication No. CN203389788U discloses a cosmetic airbrush which comprises an airbrush body formed by a front handle and a tail handle which are screwed together, wherein a cavity is formed in the airbrush body, an essence cavity communicated with the cavity is formed in the external wall of the front handle, a central hole allowing essence to be sprayed out is formed in a side, opposite to a screwed end, of the front handle, and a nozzle is arranged at the central hole and is in threaded connection with the central hole. The cosmetic airbrush is provided with a spray needle which penetrates through the nozzle and the central hole and is matched with a nozzle opening to form a sealing surface, and an air valve is arranged at an end, opposite to the nozzle, of the front handle and has an air outlet communicated with the central hole; a button is arranged on the airbrush body and is located over the air valve, the tail end of the button is connected with a core of the air valve, and the button is radially pressed to control the air valve to be opened or closed; and a spray needle clamping device is arranged in the cavity and is fixedly connected with the spray needle, the button is axially shifted to control the spray needle clamping device to move axially so as to control the spray needle to move, and accordingly, the amount of the essence sprayed out via the nozzle opening is regulated. When the cosmetic airbrush is used, the essence is poured into the essence cavity, the button is pressed to open the air valve to allow compressed air to enter the cavity of the airbrush body, and then the button is moved axially to control the spray needle to move axially so that the essence is extruded out of the nozzle by the compressed air. According to the airbrush, the air valve and the spray needle are simultaneously opened through the same button, so that operation of the cosmetic airbrush is simplified.

As another example, Chinese Utility Model Patent Publication No. CN 208411279U discloses an air pump airbrush which is integrated with a battery module to solve the problem of inconvenient movement and operation of electrically-driven air pump airbrushes. A control circuit board is arranged under an operating button of existing airbrushes and has a control key on the surface, and the operating button is fixedly connected with the control circuit board through the control key so as to control power supply of the battery module.

However, in the above-mentioned technical solution, the airbrush and an air pump used for supplying the compressed air are arranged separately, namely the air pump pumps the compressed air into the cavity of the airbrush body through an air pipe, and consequentially, when used by users, the airbrush cannot be held or operated by hand due to the fact that the button of the existing airbrush is arranged on the upper side of the airbrush body, and it's inconvenient for users to move and operate the airbrush due to the connection interference of the air pipe of the air pump on the airbrush.

BRIEF SUMMARY OF THE INVENTION

The objective of the invention is to overcome the above-mentioned shortcomings of the prior art by providing a hand-held integral airbrush which is so designed that an air pump and an airbrush are integrated in an ergonomically designed grab handle and are synchronously controlled through a trigger-type operating button to operate, and thus, the hand-held integral airbrush is more convenient to hold and operate.

The technical solution adopted by the invention to fulfill the above-mentioned objective is as follows:

A hand-held integral airbrush comprises a shell provided with a grab handle, wherein an upper accommodating cavity and a lower accommodating cavity are formed in the shell, an airbrush assembly is arranged in the upper accommodating cavity of the shell, and an air pump assembly is arranged in the lower accommodating cavity of the shell and is used for pumping compressed air into the airbrush assembly. The hand-held integral airbrush further comprises an operating button which is arranged on the grab handle of the shell in a reciprocating manner through an elastic part, is stressed by an elastic force of the elastic part when pressed, and includes a second control part. When the operating button is pressed, the second control part controls the opening degree of a nozzle of the airbrush assembly according to displacement changes of the operating button in the pressing stroke of the operating button; and when the operating button is released, the operating button returns under the elastic force of the elastic part, and the second control part controls the nozzle of the airbrush assembly to close.

In this technical solution, the operating button is a single-control switch button, that is to say, only one control part is configured on the operating button to control the airbrush assembly, and the air pump assembly is controlled to start or stop by other switches; or an air pump works all the time and does not need to be controlled.

The hand-held integral airbrush comprises a shell provided with a grab handle, wherein an upper accommodating cavity and a lower accommodating cavity are formed in the shell, an airbrush assembly is arranged in the upper accommodating cavity of the shell, and an air pump assembly is arranged in the lower accommodating cavity of the shell and is used for pumping compressed air into the airbrush assembly. The hand-held integral airbrush further comprises a switch part used for controlling the air pump assembly to start or stop, as well as an operating button which is arranged on the grab handle of the shell in a reciprocating manner through an elastic part, is stressed by an elastic force of the elastic part when pressed, and includes a first control part and a second control part. When the operating button is pressed, the first control part controls the switch part to be in an on-state in the presses process of the operating button so as to control the air pump assembly to start, the second control part controls the opening degree of the nozzle of the airbrush assembly according to displacement changes of the operating button in the pressing stroke of the operating button; and when the operating button is released, the operating button returns under the elastic force of the elastic part, the first control part controls the switch part to be in an off-state so as to control the air pump assembly to stop, and the second control part controls the nozzle of the airbrush assembly to close.

In this technical solution, the operating button is a double-control switch button, and the airbrush assembly and the air pump assembly are controlled by the two control parts of the operating button; when the air pump assembly is controlled, the switch part is matched with the corresponding control part of the operating button to control the air pump assembly to start or stop.

Furthermore, the switch part is an inching switch, the first control part is a stop block matched with a contact of the inching switch; the second control part is a shifting block stretching into the airbrush assembly, and a straight slot allowing a spray needle of the airbrush assembly to be inserted therein is formed in the shifting block; and the elastic part is a spring having two ends respectively abutting against the internal wall of the shell and the internal side of the operating button.

Furthermore, the operating button further includes a third control part, and a self-locking rebound device matched with the third control part is arranged in the shell; when the operating button is pressed and the third control part drives the self-locking rebound device to a self-locking position, the operating button is limited and fixed to a press position; and when the operating button is further pressed and the third control part drives the self-locking rebound device to a rebound position, the operating button is released and returns under the elastic force of the elastic part.

Furthermore, the third control part is a clamping groove fixedly connected to a movable end of the self-locking rebound device.

Furthermore, a rear cover is detachably connected to the rear end of the shell, corresponds to the tail of the airbrush assembly, and is made from soft rubber; a front cover is detachably connected to the front end of the shell and is arranged around the nozzle of the airbrush assembly; a top cover is detachably connected to the upper end of the shell, and a feed hole matched with a feed inlet of the airbrush assembly is formed in the top cover; and a bottom cover is detachably connected to the lower end of the shell.

Furthermore, an annular groove is formed in the shell and is located between the upper accommodating cavity and the lower accommodating cavity, and a sealing part is arranged around the upper part of the air pump assembly and is closely clamped in the annular groove.

Furthermore, the first control part, the second control part, and the third control part of the operating button are integrally formed and are located in the upper accommodating cavity, and the inching switch, the self-locking rebound device, and the spring are located in the upper accommodating cavity.

Furthermore, a power supply assembly and a circuit control board are arranged in the lower accommodating cavity, a power button exposed out of the surface of the shell is arranged on the circuit control board, the power supply assembly supplies power to the air pump assembly through the circuit control board, and the power button is used for circuit control of the circuit control board; a display screen exposed out of the surface of the shell is also arranged on the circuit control board and is used for displaying the working state of the air pump assembly and/or the power supply assembly; and a charge port used for charging the power supply assembly and/or a power supply port used for supplying power to the air pump assembly are/is arranged on the circuit control board and stretch/stretches out of the bottom end of the shell, and a shiftable soft rubber pad is arranged on the bottom cover and corresponds to the charge port and/or the power supply port.

Furthermore, the airbrush assembly is provided with an air inlet pipe connector, the air pump assembly is provided with an air exhaust pipe connector, and the air inlet pipe connector is communicated with the air exhaust pipe connector through an air pipe arranged in the upper accommodating cavity of the shell.

Furthermore, the airbrush assembly includes an airbrush body having an accommodating cavity formed therein, and a feed assembly communicated with the accommodating cavity is arranged on the upper side of the airbrush body; a central spray hole communicated with the accommodating cavity is formed in a nozzle assembly connected to the front end of the airbrush body, the air inlet pipe connector stretches into one end of the airbrush assembly to correspond to the central spray hole; a spring sleeve is connected to the rear end of the airbrush body, and a clamp spring and a spray needle clamping shaft penetrating through the clamp spring are arranged in the spring sleeve in a sleeved manner; a locking nut is connected to the rear end of the spring sleeve; and two ends of the clamp spring respectively abut against the spray needle clamping shaft and the locking nut, and a spray needle stretching into the accommodating cavity to be matched with the central spray hole is clamped on the spray needle clamping shaft.

Furthermore, a sliding groove allowing the second control part of the operating button to stretch therein is formed in the rear end of the airbrush body and corresponds to the spray needle clamping shaft, and the second control part abuts against the spray needle clamping shaft when stretching into the sliding groove.

Furthermore, the air pump assembly includes an air compressor pump and a motor driving the air compressor pump to operate, wherein the air compressor pump is arranged at the upper end of the motor and is in drive connection with an output shaft of the motor. The air pump assembly is integrally and fixedly clamped in the lower accommodating cavity of the shell.

Furthermore, the shell is formed by a left half shell and a right half shell which are combined together, so that assembly is convenient.

By adoption of the above-mentioned technical solutions, compared with the prior art, the invention has the following advantages:

In the prior art, firstly, the airbrush has no special grab handle, and an operating button is located above an airbrush body, so that when the airbrush is held by hand and the operating button is pressed, control over the direction of a nozzle will be seriously affected by an arm, the accuracy of the opening degree of the nozzle of the airbrush cannot be easily controlled, and consequentially, the airbrush is inconvenient to use; secondly, the airbrush and an air pump are separately arranged and are connected through an air pipe, and the exposed air pipe may hinder movement of the airbrush to a certain degree, and consequentially, operation of the airbrush is affected; and thirdly, the operating button of the airbrush needs to be moved in two directions to perform control, that is to say, the operating button is pressed downwards to control an air valve or air pump and is moved axially horizontally to control the opening degree of the nozzle, and the operating button in such a control manner has low control accuracy. Compared with the prior art, the hand-held integral airbrush includes the shell provided with the ergonomically designed grab handle, so that the hand feeling of gripping is improved, and overall control over the hand-held integral airbrush is facilitated. The air pump assembly and the airbrush assembly are integrated in the shell, movement of the airbrush and changes to the direction of the nozzle are not affected by the gripping manner and the pipe, so that the hand-held integral airbrush is more convenient to operate. Besides, the operating button similar to a trigger structure is arranged on the grab handle, so that the operating button can be conveniently controlled while the hand-held integral airbrush is held; and the operating button can be pressed in one direction to control both the air pump assembly and the airbrush assembly, so that compared with the prior art, the hand-held integral airbrush is more convenient to hold and operate.

According to the invention, the shell, the airbrush assembly, the operating button, the air pump assembly, and the like are further designed creatively, and the beneficial effects of the invention are further expounded as follows with reference to implementations and are not given herein.

BRIEF DESCRIPTION OF THE SEVERAL VIEWS OF THE DRAWINGS

The invention is further expounded as follows in combination with the accompanying drawings and embodiments.

REFERENCE SIGNS

100, grab handle; 10, shell; 11, upper accommodating cavity; 12, lower accommodating cavity; 13, installation hole; 14, opening; 15, annular groove; 20, airbrush assembly; 21, airbrush body; 22, copper cap; 23, nozzle assembly; 24, spring sleeve; 25, spray needle clamping shaft; 26, locking nut; 27, spray needle; 28, air inlet pipe connector; 30, air pump assembly; 31, air compressor pump; 32, motor; 33, air exhaust pipe connector; 40, switch part; 41, inching switch; 42, contact; 43, circuit board; 50, operating button; 51, first control part; 52, second control part; 53, third control part; 60, elastic part; 70, self-locking rebound device; 71, movable end; 80, power supply assembly; 90, circuit control board; 91, power button; 92, display screen; 101, rear cover; 102, front cover; 103, top cover; 104, bottom cover; 211, sliding groove; 311, sealing part; 521, straight slot; 1011, belt; 1012, positioning buckle; 1013, positioning hole; 1031, feed hole; 1032, sealing ring.

DETAILED DESCRIPTION OF THE INVENTION

The embodiments in the following description are only preferred ones of the invention, and are not intended to limit the protection scope of the invention.

Figure 1:
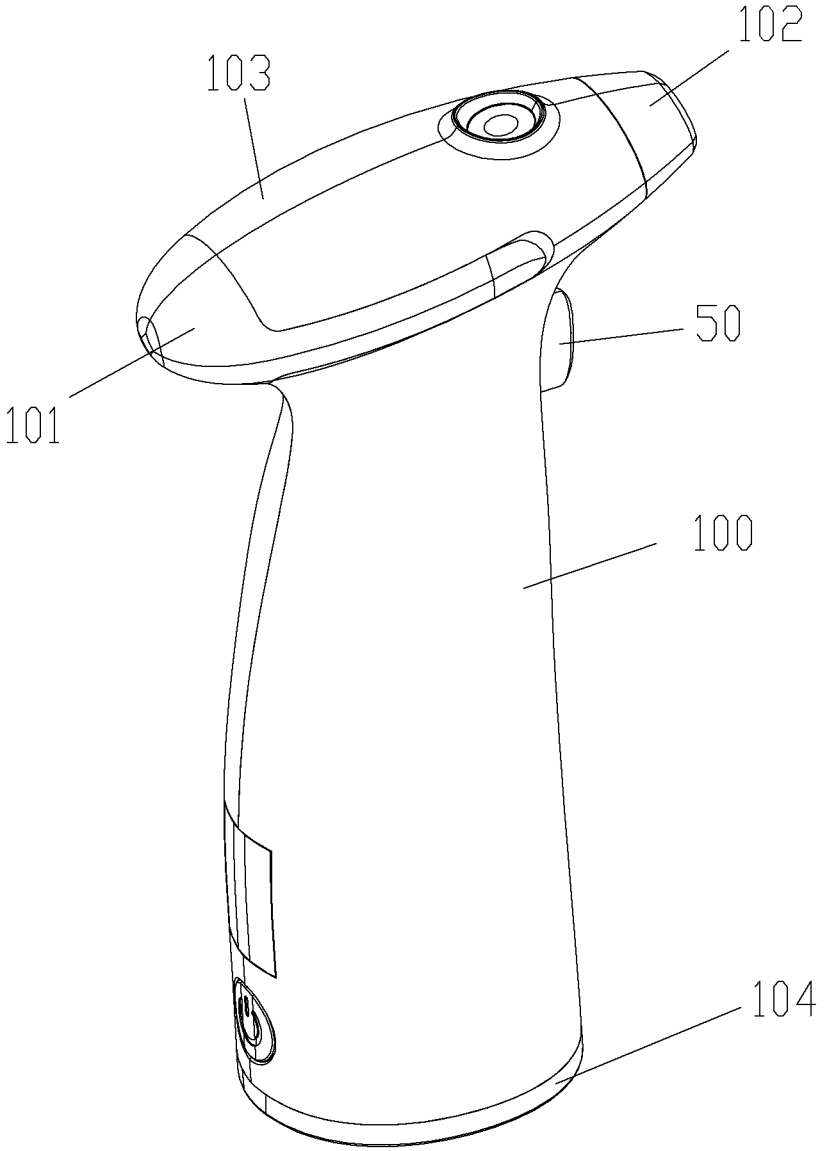
FIG. 1 is a perspective view of the invention.
Figure 2:
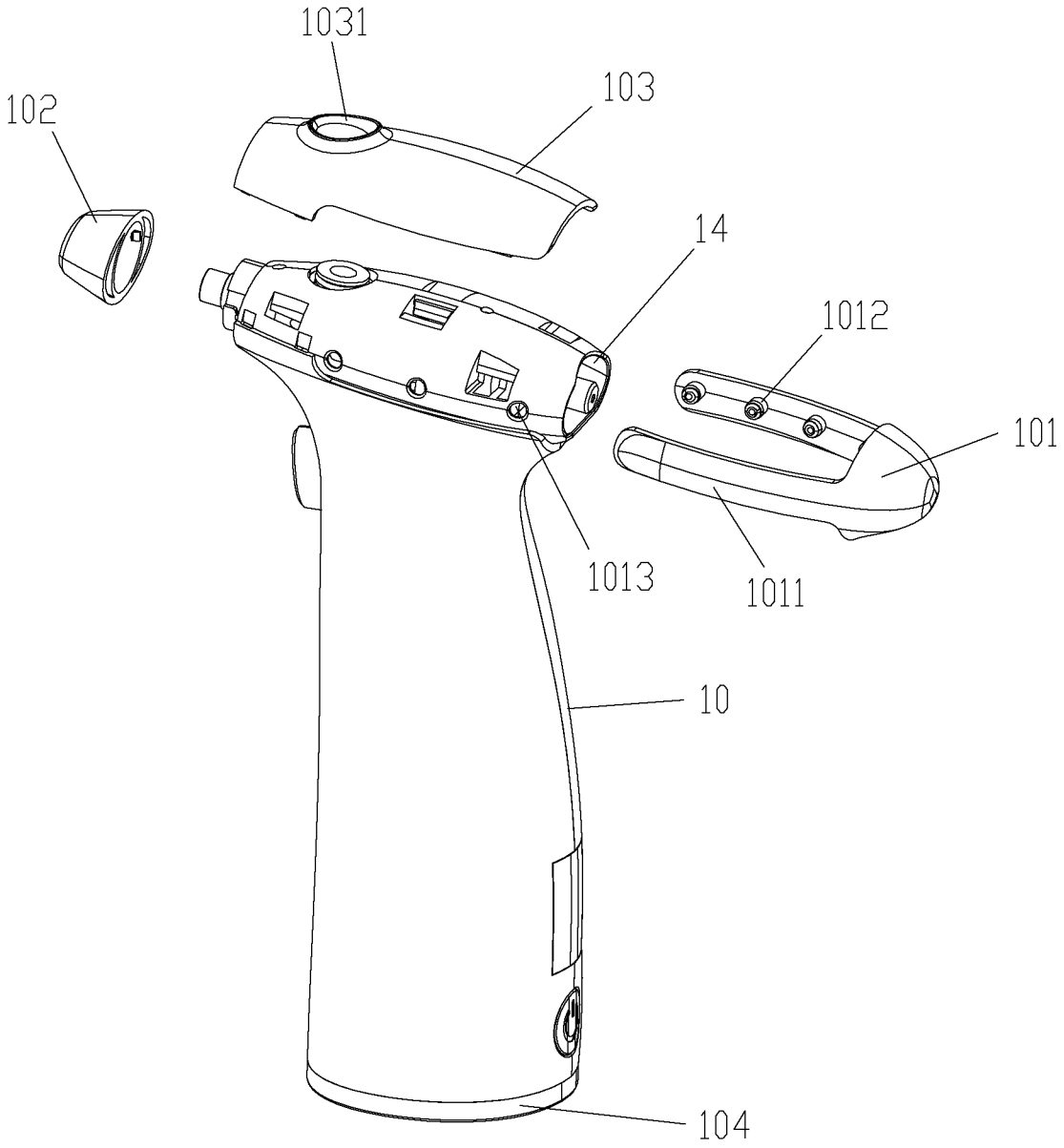
FIG. 2 is an exploded view of the invention.

Referring to FIG. 1 and FIG. 2, a hand-held integral airbrush comprises a shell 10 having a grab handle 100, wherein the shell 10 is preferably a hard injection-molded part and is formed by a left half shell and a right half shell which are combined together, so that assembly is convenient.

Figure 3:
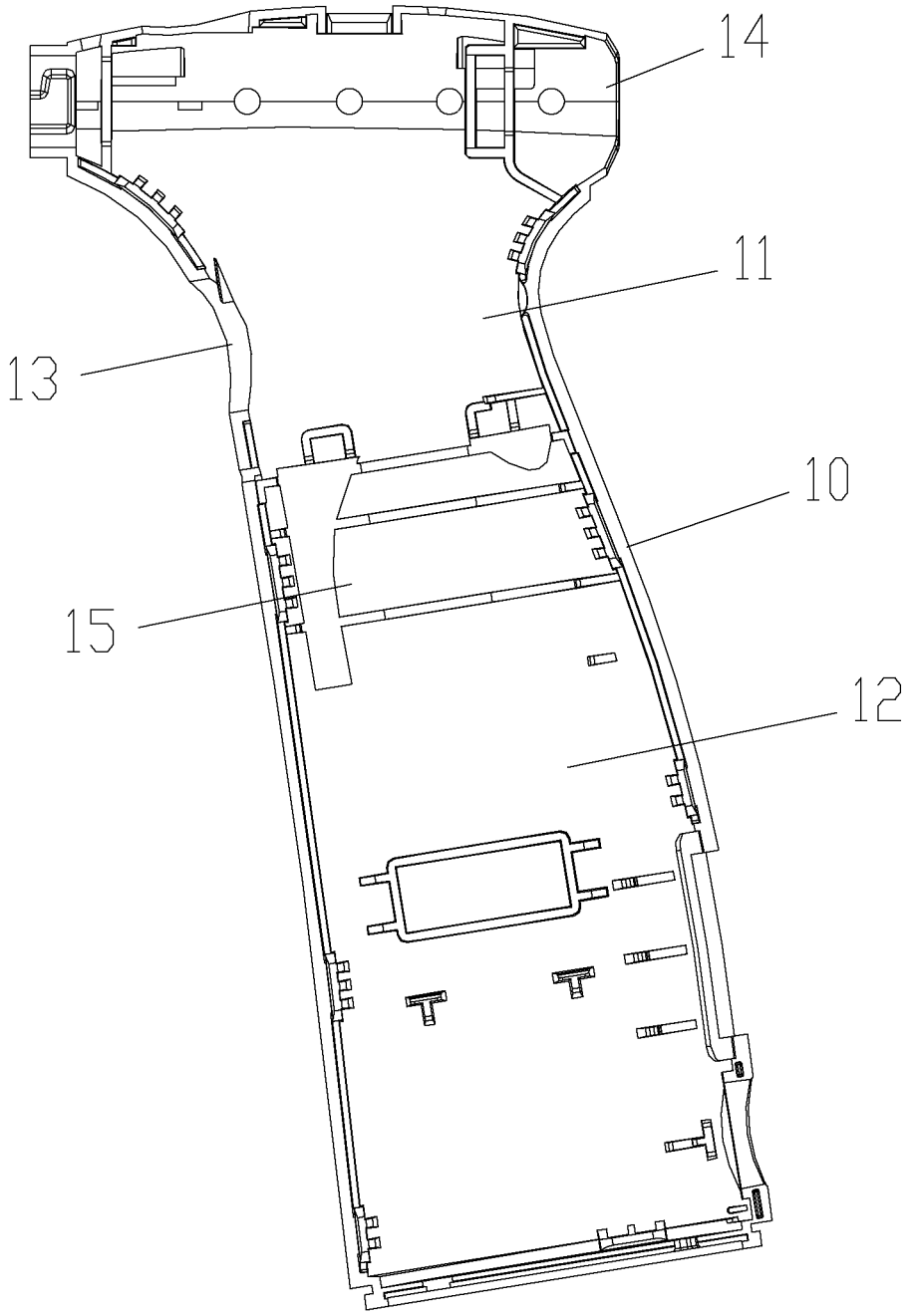
FIG. 3 is an internal structural view of a shell of the invention.
Figure 4:
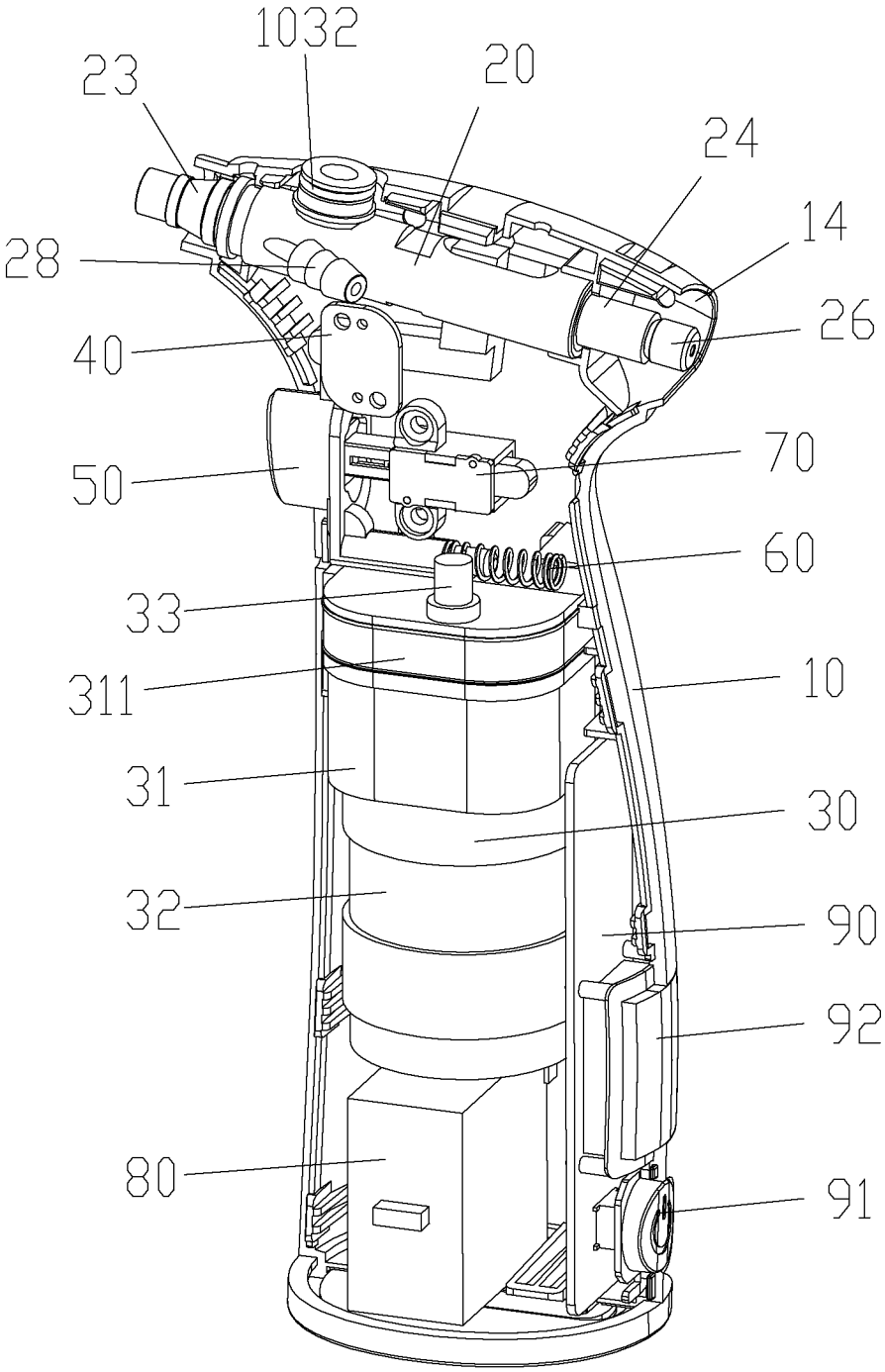
FIG. 4 is an internal assembly diagram of the shell of the invention.

Referring to FIG. 3 and FIG. 4, an upper accommodating cavity 11 and a lower accommodating cavity 12 are formed in the shell 10, an airbrush assembly 20 is arranged in the upper accommodating cavity 11 of the shell 10, and an air pump assembly 30 is arranged in the lower accommodating cavity 12 of the shell 10 and is used for pumping compressed air into the airbrush assembly 20.

Figure 5:
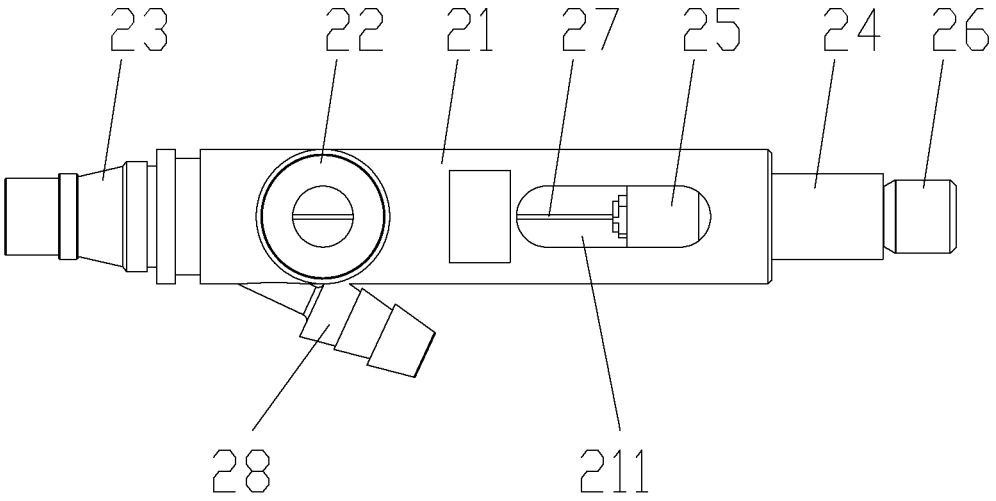
FIG. 5 is a top view of an airbrush assembly of the invention.

Referring to FIG. 5, the airbrush assembly 20 includes an airbrush body 21 having an accommodating cavity formed therein, and a feed assembly communicated with the accommodating cavity is arranged on the upper side of the airbrush body 21. Particularly, the feed assembly is a copper cap 22 provided with a feed passage, the airbrush body 21 is a hollow metal cylinder, a circular hole is formed in the upper side of the airbrush body 21, the copper cap 22 is fixedly welded in the circular hole, the feed passage of the copper cap 22 is communicated with the accommodating cavity of the airbrush body 21, and the copper cap 22 is connected with a cup containing coating.

A central spray hole communicated with the accommodating cavity is formed in a nozzle assembly 23 connected to the front end of the airbrush body 21; a spring sleeve 24 is connected to the rear end of the airbrush body 21, and a clamp spring (not shown) and a spray needle clamping shaft 25 penetrating through the clamp spring are arranged in the spring sleeve 24 in a sleeved manner; a locking nut 26 is connected to the rear end of the spring sleeve 24; and two ends of the clamp spring respectively abut against the spray needle clamping shaft 25 and the locking nut 26, and a spray needle 27 stretching into the accommodating cavity to be matched with the central spray hole is clamped on the spray needle clamping shaft 25.

When assembled, the nozzle assembly 23 is connected to the front end of the airbrush body 21 first, the spring sleeve 24 is screwed to the rear end of the airbrush body 21, and the spray needle 27 is inserted into the spray needle clamping shaft 25; then the spray needle clamping shaft 25 and the clamp spring are sequentially arranged in the spring sleeve 24 in a sleeved manner; and finally the locking nut 26 and the spring sleeve 24 are tightly screwed together. After being assembled, the nozzle assembly 23 is fixedly arranged in the upper accommodating cavity 11 of the shell 10.

Referring to FIG. 4, the air pump assembly 30 includes an air compressor pump 31 and a motor 32 driving the air compressor pump 31 to operate, wherein the air compressor pump 31 is arranged at the upper end of the motor 32 and is in drive connection with an output shaft of the motor 32; and the air pump assembly 30 is integrally and fixedly clamped in the lower accommodating cavity 12 of the shell 10.

The hand-held integral airbrush in this implementation has a working process similar to that of the airbrushes mentioned in the description of the related art, and the working principle of the air pump assembly 30 to output compressed air is common technical knowledge in this field, and therefore unnecessary details are not given herein. It should be noted that although the structure and principle of the airbrush assembly in this implementation are similar to those of the airbrushes mentioned in the description of the related art, the airbrush assembly 20 and the air pump assembly 30 are not limited to such structure and the principle, and other conventional structures of the airbrush assembly and the air pump assembly in this field can be used for equivalent replacement within the scope of the invention.

Furthermore, the airbrush assembly 20 is provided with an air inlet pipe connector 28 which stretches into one end of the airbrush assembly 20 to correspond to the central spray hole, the air pump assembly 30 is provided with an air exhaust pipe connector 33, and the air inlet pipe connector 28 is communicated with the air exhaust pipe connector 33 through an air pipe (not shown) arranged in the upper accommodating cavity 11 of the shell 10. Particularly, the air inlet pipe connector 28 is arranged beside the airbrush body 21, so that the air pipe can be as close as possible to the internal wall of the shell 10, and accordingly, an operating button 50 can be pressed without being affected.

Figure 6:
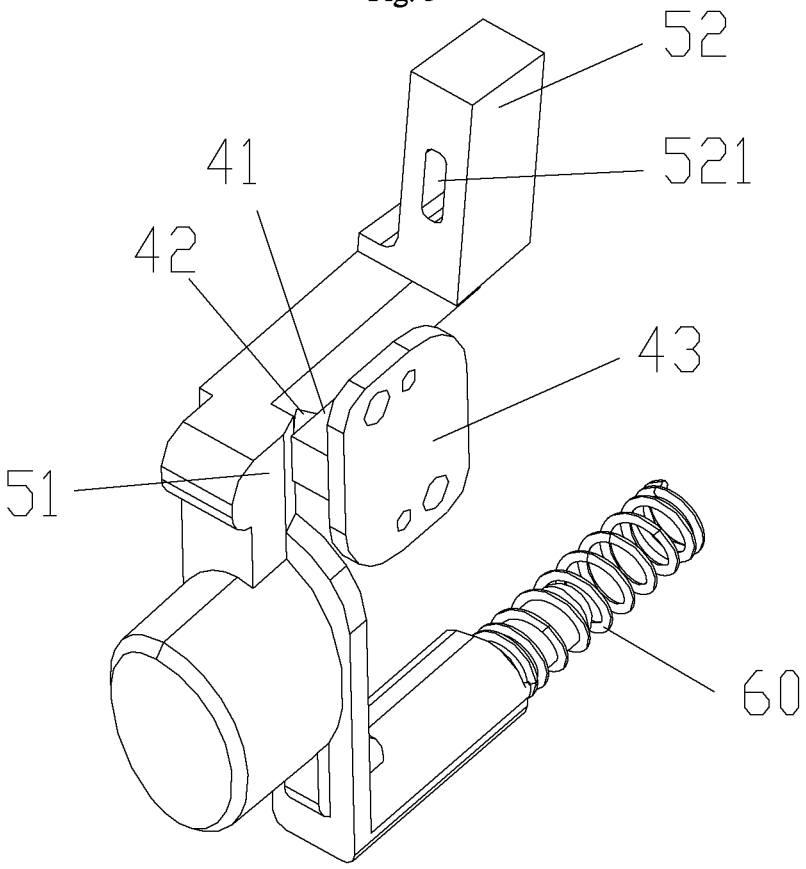
FIG. 6 is a structural view of the cooperation of an operating button and an inching switch of the invention.

Referring to FIG. 6, the hand-held integral airbrush further comprises a switch part 40 used for controlling the air pump assembly 30 to start or stop. Particularly, the switch part 40 includes an inching switch 41 which is a conventional switch and includes a switch contact 42, wherein the switch contact 42 can be touched to realize switch control, and the inching switch 41 is fixedly arranged on the internal wall of the upper accommodating cavity 11 of the shell 10 through a circuit board 43 and is electrically connected with the air pump assembly 30.

Referring to FIG. 3 and FIG. 4, the hand-held integral airbrush in this implementation further comprises the operating button 50 arranged on the grab handle 100 of the shell 10 in a reciprocating manner through an elastic part 60. Particularly, the elastic part 60 is a spring, a pressing part of the operating button 50 is exposed out of the shell 10 and is matched with human fingers, a guide column is arranged on the operating button 50 and is located on the internal side of the shell 10, the spring sleeve is arranged around the guide column, and two ends of the spring respectively abut against the internal wall of the shell 10 and the internal side of the operating button 50. An installation hole 13 matched with the pressing part is formed in the shell 10, the operating button 50 reciprocates on the shell 10 under the limit fit of the pressing part and the installation hole 13, and when pressed, the operating button 50 keeps moving, under the effect of an elastic force of the elastic part 60, to stretch out of the shell 10; and when released, the operating button 50 moves to return.

Figure 7:
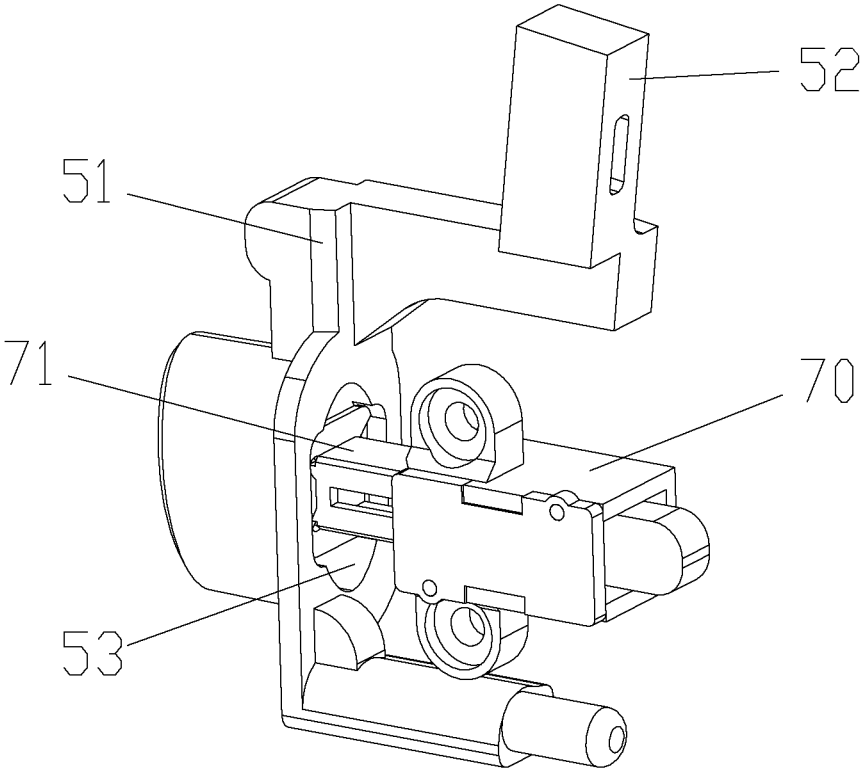
FIG. 7 is a structural view of the cooperation of the operating button and a self-locking rebound device of the invention.

Referring to FIG. 6 and FIG. 7, the operating button 50 includes a first control part 51 and a second control part 52. When the operating button 50 is pressed, the first control part 51 controls the switch part 40 to be in an on-state in the stroke of the operating button 50 so as to control the air pump assembly 30 to start, the second control part 52 controls the opening degree of the nozzle of the airbrush assembly 20 according to displacement changes of the operating button 50 in the pressing stroke of the operating button 50; and when released, the operating button 50 returns under the elastic force of the elastic part 60, the first control part 51 controls the switch part 40 to be in an off-state so as to control the air pump assembly 30 to stop, and the second control part 52 controls the nozzle of the airbrush assembly 20 to close.

The first control part 51 is a stop block matched with the contact 42 of the inching switch 41. When the inching switch 41 is arranged in the upper accommodating cavity 11 of the shell 10, the contact 42 of the inching switch 41 faces the moving direction of the operating button 50; and the stop block exactly touches the contact 42 in an initial state, and once the operating button 50 is pressed, the stop block is maintained in contact with the contact 42 of the inching switch 41 during movement of the operating button 50, so that the inching switch 41 is kept in the on-state all the time in the pressing stroke of the operating button 50.

The second control part 52 is a shifting block stretching into the airbrush assembly 20, and a straight slot 521 allowing the spray needle 27 of the airbrush assembly 20 to penetrate through is formed in the shifting block and has an avoidance effect on of the spray needle 27. Particularly, referring to FIG. 5, a sliding groove 211 allowing the shifting block to stretch therein is formed in the rear end of the airbrush body 21 and corresponds to the spray needle clamping shaft 25, the shifting block abuts against the spray needle clamping shaft 25 when stretching into the sliding groove 211, and when the operating button 50 is pressed to reciprocate, the shifting block slides back and forth in the sliding groove 211 to drive the spray needle clamping shaft 25 to axially reciprocate in the airbrush body 21 so as to regulate the degree of an opening between the spray needle 27 and the nozzle assembly 23, and therefore the quantity of coating sprayed out is regulated.

Referring to FIG. 4 and FIG. 7, as a preferred implementation, the operating button 50 further includes a third control part 53, and a self-locking rebound device 70 matched with the third control part 53 is arranged in the shell 10; when the operating button 50 is pressed and the third control part 53 drives the self-locking rebound device 70 to a self-locking position, the operating button 50 is limited and fixed to a press position; and when the operating button 50 is further pressed and the third control part 53 drives the self-locking rebound device 70 to a rebound position, the operating button 50 is released and returns under the elastic force of the elastic part 60. The structure and principle of the self-locking rebound device 70 are common technical knowledge in this field, and as a structural part capable of realizing a self-locking rebounding function, the self-locking rebound device can be purchased on the market, and therefore unnecessary details are not given herein.

Furthermore, the third control part 53 is a clamping groove fixedly connected to a movable end 71 of the self-locking rebound device 70. After the clamping groove is fixedly connected to the movable end 71 of the self-locking rebound device 70, the movable end 71 of the self-locking rebound device 70 moves synchronously with the operating button 50, and when the self-locking rebound device 70 is located at a self-locking position, the operating button 50 is also limited and locked at this position. Generally, the self-locking position of the self-locking rebound device 70 is close to the maximum contraction position of the movable end 71, that is to say, when the operating button 50 is limited and locked, the operating button 50 is pressed to the maximum extent, in this case, the shifting block shifts the spray needle clamping shaft 25 until the degree of the opening between the spray needle 27 and the nozzle assembly 23 is maximized, and at this moment, the airbrush can continuously operate at the maximum spraying rate without pressing the operating button 50.

Referring to FIG. 1 and FIG. 2, as a preferred implementation, a rear cover 101 is detachably connected to the rear end of the shell 10 and corresponds to the tail of the airbrush assembly 20. After the rear cover 101 is disassembled, an opening 14 is formed in the rear end of the shell 10, the locking nut 26 can be unscrewed from the rear end of the airbrush body 21 via the opening 14, and then the clamp spring, the spray needle clamping shaft 25, and the spray needle 27 can be sequentially taken out, so that cleaning or replacement of assembly parts is facilitated.

The rear cover 101 is made from soft rubber, belts 1011 are arranged on two sides of the rear cover 101, a plurality of positioning buckles 1012 are arranged on each belt 1011, positioning holes 1013 matched with the positioning buckles 1012 are formed in two sides of the shell 10, and the positioning buckles 1012 are buckled in the positioning holes 1013 to detachably and fixedly connect the belts 1011 to the rear end of the shell 10. Of course, the rear cover 101 can also be made from hard materials, and can be detachably connected to the shell 10 in an inserted manner, a clamped manner, a screwed manner, or the like. The belts 1011 made from the soft rubber in this implementation have an anti-collision function, are convenient to assemble and disassemble, and are attractive to fulfill a decoration effect.

Similarly, a front cover 102 is detachably connected to the front end of the shell 10 and is arranged around the nozzle of the airbrush assembly 20. After the front cover 102 is disassembled, an opening is formed at the front end of the shell 10, and the nozzle assembly 23 can be taken out via the opening to be cleaned or replaced.

Furthermore, a top cover 103 is detachably connected to the upper end of the shell 10, and a feed hole 1031 matched with a feed inlet of the airbrush assembly 20 is formed in the top cover 103. Particularly, the diameter of the feed hole 1031 in the top cover 103 is matched with the external diameter of the copper cap 22, an annular groove used for installing a sealing ring 1032 is formed at the periphery of the copper cap 22, and a gap between the feed hole 1031 and the copper cap 22 is sealed by the sealing ring 1032, so that the coating is prevented from flowing into the shell 10 along the gap between the feed hole 1031 and the copper cap 22.

Furthermore, a bottom cover 104 is detachably connected to the lower end of the shell 10, is made from soft rubber, and is used for sealing the lower end of the shell 10 to protect the shell 10 against collision damage.

Referring to FIG. 3 and FIG. 4, as a preferred implementation, an annular groove 15 is formed in the shell 10 and is located between the upper accommodating cavity 11 and the lower accommodating cavity 12, and a sealing part 311 is arranged around the upper part of the air pump assembly 30 and is closely clamped into the annular groove 15. The upper accommodating cavity 11 and the lower accommodating cavity 12 in the shell 10 are separated and sealed by the sealing part 311 on the upper part of the air pump assembly 30, and the upper accommodating cavity 11 is used for installing execution control parts such as the airbrush assembly 20 and the switch button 50. Particularly, the first control part 51, the second control part 52, and the third control part 53 of the operating button 50 are integrally formed and are located in the upper accommodating cavity 11, and the inching switch 41, the self-locking rebound device 70, and the elastic part 60, which have low waterproof requirements, are located in the upper accommodating cavity 11; and the lower accommodating cavity 12 is used for installing the air pump assembly 30 and electrical parts having high waterproof requirements such as the motor 32, the a circuit control board 90, and a power supply assembly 80.

Furthermore, the power supply assembly 80 and the circuit control board 90 are arranged in the lower accommodating cavity 12, a power button 91 exposed out of the surface of the shell 10 is arranged on the circuit control board 90, the power supply assembly 80 supplies power to the air pump assembly 30 through the circuit control board 90, and the power button 91 is used for circuit control of the circuit control board 90; and a circuit board 43 of the inching switch 41 located in the upper accommodating cavity 11 is electrically connected with the circuit control board 90.

A display screen 92 exposed out of the surface of the shell 10 is also arranged on the circuit control board 90 and is used for displaying the working state of the air pump assembly 30 and/or the power supply assembly 80. A charge port used for charging the power supply assembly 80 and/or a power supply port used for supplying power to the air pump assembly 30 are/is arranged on the circuit control board 90 and stretch/stretches out of the bottom end of the shell 10, and a shiftable soft rubber pad is arranged on the bottom cover 104 and corresponds to the charge port and/or the power supply port.

In this implementation, the operating button 50 includes a first control part 51, a second control part 52, and a third control part 53. However, for those skilled in this field, the operating button 50 may be a single-control switch only including the second control part 52, or the operating button 50 may be a double-control switch only including the first control part 51 and the second control part 52, and such implementation is easily achievable by simplifying this implementation and will not be detailed anymore.

The above implementations are only preferred ones of the invention, and all equivalent changes or modifications which are made according to the structures, characteristics, and principle within the patent application scope of the invention should also fall within the patent application scope of the invention.

What is claimed is:

1. A hand-held integral airbrush, comprising a shell (10) provided with a grab handle (100), wherein an upper accommodating cavity (11) and a lower accommodating cavity (12) are formed in the shell (10), an airbrush assembly (20) is arranged in the upper accommodating cavity (11) of the shell (10), and an air pump assembly (30) is arranged in the lower accommodating cavity (12) of the shell (10) and is used for pumping compressed air into the airbrush assembly (20); the hand-held integral airbrush further comprises an operating button (50) arranged on the grab handle (100) of the shell (10) in a reciprocating manner through an elastic part (60) and stressed by an elastic force of the elastic part (60) when pressed; the operating button (50) includes a second control part (52); when the operating button (50) is pressed, the second control part (52) controls an opening degree of a nozzle of the airbrush assembly (20) according to displacement changes of the operating button (50) in a pressing stroke of the operating button (50); and when the operating button (50) is released, the operating button (50) returns under the elastic force of the elastic part (60), and the second control part (52) controls the nozzle of the airbrush assembly (20) to close, wherein the hand-held integral airbrush further comprises a switch part (40) used for controlling the air pump assembly (30) to start or stop, wherein the operating button (50) further includes a first control part (51); when the operating button (50) is pressed, the first control part (51) controls the switch part (40) to be in an on-state in the pressing stroke of the operating button (50) so as to control the air pump assembly (30) to start; and when the operating button (50) is released, the operating button (50) returns under the elastic force of the elastic part (60), and the first control part (51) controls the switch part (40) to be in an off-state so as to control the air pump assembly (30) to stop.

2. The hand-held integral airbrush according to claim 1, wherein an annular groove (15) is formed in the shell (10) and is located between the upper accommodating cavity (11) and the lower accommodating cavity (12), and a sealing part (311) is arranged around an upper part of the air pump assembly (30) and is closely clamped in the annular groove (15).

3. The hand-held integral airbrush according to claim 2, wherein a power supply assembly (80) and a circuit control board (90) are arranged in the lower accommodating cavity (12), the air pump assembly (30) is integrally and fixedly clamped in the lower accommodating cavity (12) of the shell (10), the power supply assembly (80) is arranged below the air pump assembly (30), and the circuit control board (90) is clamped on an internal wall of the shell (10) and is located beside the air pump assembly (30).

4. The hand-held integral airbrush according to claim 3, wherein a power button (91) exposed out of a surface of the shell (10) is arranged on the circuit control board (90), the power supply assembly (80) supplies power to the air pump assembly (30) through the circuit control board (90), and the power button (91) is used for circuit control of the circuit control board (90).

5. The hand-held integral airbrush according to claim 3, wherein a display screen (92) exposed out of a surface of the shell (10) is arranged on the circuit control board (90) and is used for displaying the working state of the air pump assembly (30) and/or the power supply assembly (80).

6. The hand-held integral airbrush according to claim 3, wherein a charge port used for charging the power supply assembly (80) and/or a power supply port used for supplying power to the air pump assembly (30) are/is arranged on the circuit control board (90) and stretch/stretches out of a bottom end of the shell (10).

7. The hand-held integral airbrush according to claim 1, wherein the operating button (50) further includes a third control part (53), and a self-locking rebound device (70) matched with the third control part (53) is arranged in the shell (10); when the operating button (50) is pressed and the third control part (53) drives the self-locking rebound device (70) to a self-locking position, the operating button (50) is limited and fixed to a press position; and when the operating button (50) is further pressed and the third control part (53) drives the self-locking rebound device (70) to a rebound position, the operating button (50) is released and returns under the elastic force of the elastic part (60).

8. The hand-held integral airbrush according to claim 7, wherein an annular groove (15) is formed in the shell (10) and is located between the upper accommodating cavity (11) and the lower accommodating cavity (12), and a sealing part (311) is arranged around an upper part of the air pump assembly (30) and is closely clamped in the annular groove (15).

9. The hand-held integral airbrush according to claim 7, wherein the air pump assembly (30) includes an air compressor pump (31) and a motor (32) driving the air compressor pump (31) to operate, and the air compressor pump (31) is arranged at an upper end of the motor (32) and is in drive connection with an output shaft of the motor (32).

10. The hand-held integral airbrush according to claim 7, wherein the airbrush assembly (20) includes an airbrush body (21), and an accommodating cavity is formed in the airbrush body (21); a feed assembly communicated with the accommodating cavity is arranged on an upper side of the airbrush body (21); a central spray hole communicated with the accommodating cavity is formed in a nozzle assembly (23) connected to a front end of the airbrush body (21); a spring sleeve (24) is connected to a rear end of the airbrush body (21), and a clamp spring and a spray needle clamping shaft (25) penetrating through the clamp spring are arranged in the spring sleeve (24) in a sleeved manner; a locking nut (26) is connected to the rear end of the spring sleeve (24); and two ends of the clamp spring respectively abut against the spray needle clamping shaft (25) and the locking nut (26), and a spray needle (27) stretching into the accommodating cavity to be matched with the central spray hole is clamped on the spray needle clamping shaft (25).

11. The hand-held integral airbrush according to claim 1, wherein the airbrush assembly (20) includes an airbrush body (21), and an accommodating cavity is formed in the airbrush body (21); a feed assembly communicated with the accommodating cavity is arranged on an upper side of the airbrush body (21); a central spray hole communicated with the accommodating cavity is formed in a nozzle assembly (23) connected to a front end of the airbrush body (21); a spring sleeve (24) is connected to a rear end of the airbrush body (21), and a clamp spring and a spray needle clamping shaft (25) penetrating through the clamp spring are arranged in the spring sleeve (24) in a sleeved manner; a locking nut (26) is connected to the rear end of the spring sleeve (24); and two ends of the clamp spring respectively abut against the spray needle clamping shaft (25) and the locking nut (26), and a spray needle (27) stretching into the accommodating cavity to be matched with the central spray hole is clamped on the spray needle clamping shaft (25).

12. The hand-held integral airbrush according to claim 1, wherein the air pump assembly (30) includes an air compressor pump (31) and a motor (32) driving the air compressor pump (31) to operate, and the air compressor pump (31) is arranged at an upper end of the motor (32) and is in drive connection with an output shaft of the motor (32).

13. The hand-held integral airbrush according to claim 1, wherein an annular groove (15) is formed in the shell (10) and is located between the upper accommodating cavity (11) and the lower accommodating cavity (12), and a sealing part (311) is arranged around an upper part of the air pump assembly (30) and is closely clamped in the annular groove (15).

14. The hand-held integral airbrush according to claim 1, wherein the air pump assembly (30) includes an air compressor pump (31) and a motor (32) driving the air compressor pump (31) to operate, and the air compressor pump (31) is arranged at an upper end of the motor (32) and is in drive connection with an output shaft of the motor (32).

15. The hand-held integral airbrush according to claim 1, wherein the airbrush assembly (20) includes an airbrush body (21), and an accommodating cavity is formed in the airbrush body (21); a feed assembly communicated with the accommodating cavity is arranged on an upper side of the airbrush body (21); a central spray hole communicated with the accommodating cavity is formed in a nozzle assembly (23) connected to a front end of the airbrush body (21); a spring sleeve (24) is connected to a rear end of the airbrush body (21), and a clamp spring and a spray needle clamping shaft (25) penetrating through the clamp spring are arranged in the spring sleeve (24) in a sleeved manner; a locking nut (26) is connected to the rear end of the spring sleeve (24); two ends of the clamp spring respectively abut against the spray needle clamping shaft (25) and the locking nut (26); and a spray needle (27) stretching into the accommodating cavity to be matched with the central spray hole is clamped on the spray needle clamping shaft (25).

* * * * *